US009821968B2

(12) United States Patent
Nishioka

(10) Patent No.: US 9,821,968 B2
(45) Date of Patent: Nov. 21, 2017

(54) SHEET LOADING APPARATUS AND IMAGE FORMING APPARATUS INCLUDING THE SAME

(71) Applicant: KYOCERA Document Solutions Inc., Osaka (JP)

(72) Inventor: Nobuhiro Nishioka, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/992,623

(22) Filed: Jan. 11, 2016

(65) Prior Publication Data

US 2016/0214810 A1 Jul. 28, 2016

(30) Foreign Application Priority Data

Jan. 28, 2015 (JP) ..... 2015-014217

(51) Int. Cl.
*B65H 1/00* (2006.01)
*B65H 1/26* (2006.01)

(52) U.S. Cl.
CPC ..... *B65H 1/266* (2013.01); *B65H 2402/544* (2013.01); *B65H 2403/47* (2013.01); *B65H 2405/1122* (2013.01); *B65H 2511/11* (2013.01); *B65H 2511/20* (2013.01)

(58) Field of Classification Search
CPC ..... B65H 1/266; B65H 2511/12; B65H 2701/1131; B65H 2511/11; B65H 2511/20; B65H 1/00; B65H 2405/1116; B65H 2405/112; B65H 2405/113; B65H 2405/114; B65H 2511/10
See application file for complete search history.

(56) References Cited

U.S. PATENT DOCUMENTS 8,052,141 B2 * 11/2011 Yamagishi ..... B65H 1/266 271/171
9,199,808 B2 * 12/2015 Shiokawa ..... B65H 1/266
2006/0222434 A1 * 10/2006 Kitamura ..... B65H 1/04 400/624
2008/0298873 A1 * 12/2008 Yamagishi ..... B65H 1/266 400/624

(Continued)

FOREIGN PATENT DOCUMENTS

JP H 6-127707 A 5/1994

*Primary Examiner* — Thomas Morrison
(74) *Attorney, Agent, or Firm* — Stein IP, LLC

(57) ABSTRACT

A sheet loading apparatus includes: a sheet loading portion that includes a bottom portion on which a sheet is loaded; and a regulating mechanism that butts an end edge of the sheet extending in a first direction to limit a position of the sheet in a second direction. The regulating mechanism includes: a guide portion that is formed on the bottom portion to extend in the second direction; and a limiting member slidable along the guide portion. The guide portion includes: first engaged portions that are formed at predetermined intervals along the second direction; and a second engaged portion that is formed continuously along the second direction. The limiting member includes: a pair of engaging portions that are composed of: a first engagement portion able to engage with one of the first engaged portions; and a second engagement portion which engages with the second engaged portion.

12 Claims, 5 Drawing Sheets

(56) References Cited

U.S. PATENT DOCUMENTS

| | | | | |
|---|---|---|---|---|
| 2010/0270735 | A1* | 10/2010 | Allwright | B65H 1/266<br>271/171 |
| 2011/0210501 | A1* | 9/2011 | Shiokawa | B65H 1/266<br>271/241 |

* cited by examiner

SHEET LOADING APPARATUS AND IMAGE FORMING APPARATUS INCLUDING THE SAME

INCORPORATION BY REFERENCE

The present application is based on Japanese Patent Application No. 2015-14217 filed on Jan. 28, 2015, the contents of which are hereby incorporated by reference.

BACKGROUND

The present disclosure relates to a sheet loading apparatus in which a sheet is loaded and an image forming apparatus that includes the sheet loading apparatus.

Conventionally, as a sheet loading apparatus in which a sheet is loaded, a sheet loading apparatus is known which is provided in an image forming apparatus. A sheet loading apparatus includes a sheet storing portion and a cursor that limits a sheet position. The sheet loading portion is loaded with sheets of various sizes. Accordingly, the cursor is slidable in the sheet storing portion.

According the above technology, to deal with a nonstandard-size sheet, the cursor is fixable at an arbitrary position. Besides, to deal with a standard-size sheet, the cursor is also fixable at a predetermined position. Because of this, a fixing mechanism for fixing the cursor becomes complicated.

SUMMARY

A sheet loading apparatus according to an aspect of the present disclosure is a sheet loading apparatus that includes a sheet loading portion and a regulating mechanism. The sheet loading portion includes a bottom portion on which a sheet is loaded. The regulating mechanism is disposed in the sheet loading portion and butts an end edge of the sheet extending in a first direction to limit a position of the sheet in a second direction which intersects the first direction perpendicularly. The regulating mechanism includes: a guide portion that is formed on the bottom portion to extend in the second direction; and a limiting member that is slidable along the guide portion in the second direction and abuts the end edge of the sheet. The guide portion includes: a plurality of first engaged portions that are formed at predetermined intervals along the second direction; and a second engaged portion that is formed continuously along the second direction. The limiting member includes: a pair of engaging portions that are composed of: a first engagement portion able to engage with any one of the plurality of first engaged portions because of sliding of the limiting member; and a second engagement portion which engages with the second engaged portion and whose position of the engagement with the second engaged portion changes because of the sliding of the limiting member.

Still other objects of the present disclosure and specific advantages obtained by the present disclosure will become more apparent from the following detailed description of a preferred embodiment.

DETAILED DESCRIPTION

Figure 1:
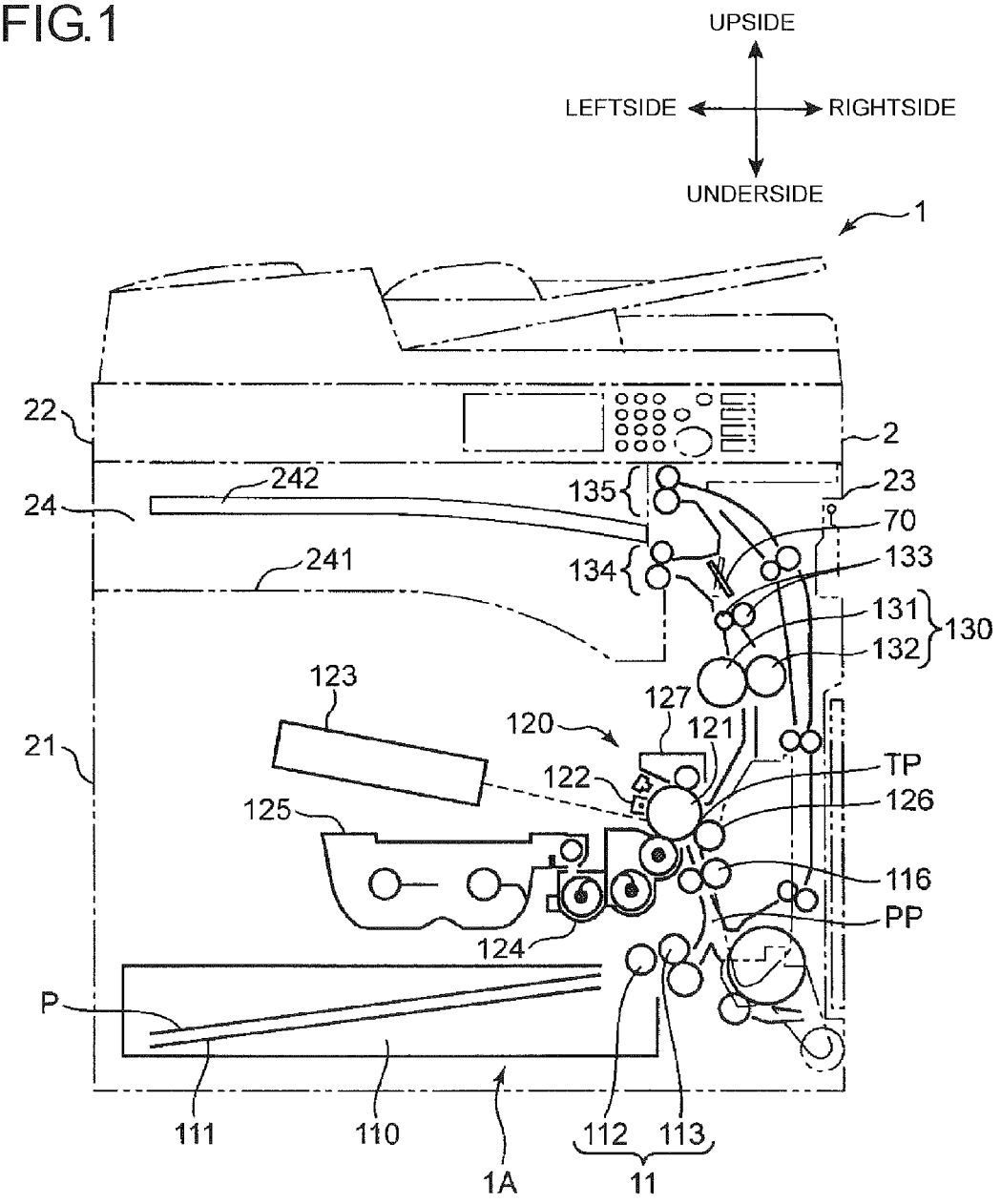
FIG. 1 is a cross-sectional view of an image forming apparatus 1 in which a sheet feeding cassette 110, which includes a sheet loading apparatus 1A according to the present disclosure, is disposed in a mountable and demountable manner.

Hereinafter, with reference to the drawings, an embodiment of the present disclosure is described. FIG. 1 is an internal cross-sectional view of the image forming apparatus 1 in which the sheet feeding cassette 110 which includes the sheet loading apparatus 1A according to the present disclosure is disposed in a mountable and demountable manner. The image forming apparatus 1 shown in FIG. 1 is a so-called monochromatic printer, but in another embodiment, the image forming apparatus may be a color printer, a facsimile apparatus, a multi-functional peripheral that includes these functions, or another apparatus that forms a toner image on a sheet. In the meantime, the terms "over", "below", "front", "rear", "left", "right", which indicate directions, are merely intended for the sake of clarity of the description and do not limit the principle of the image forming apparatus. Besides, in the following description, the term "sheet" means a copy sheet, a coated paper, an OHP sheet, a cardboard, a postcard, a tracing paper, another sheet material that undergoes an image forming process, and a sheet material that undergoes an arbitrary process other than the image forming process.

The image forming apparatus 1 includes a main housing 2 that has a substantially rectangular parallelepiped shape. The main housing 2 includes a lower housing 21 (housing) that has a substantially rectangular parallelepiped shape, an upper housing 22 that is disposed over the lower housing 21 and has a substantially rectangular parallelepiped shape, and a connecting housing 23 that connects the lower housing 21 and the upper housing 22 to each other. The connecting housing 23 extends along a right edge and rear edge of the main housing 2. A sheet after undergoing a printing process is ejected into an ejecting space 24 enclosed by the lower housing 21, the upper housing 22, and the connecting housing 23. Especially, in the present embodiment, a sheet is ejected onto a sheet ejecting portion 241 disposed on an upper surface of the lower housing 21 or onto a sheet ejecting tray 242 disposed over the sheet ejecting portion 241. The upper housing 22 houses an image reading portion for mainly reading an image of a document, and an electronic circuit responsible for whole control of the image forming apparatus 1.

The image forming apparatus 1 includes a sheet feeding cassette 110 (sheet loading portion), a sheet feeding portion 11, a registration roller pair 116, and an image forming portion 120. The sheet feeding portion 11 includes a pickup roller 112 and a sheet feeding roller 113. The sheet feeding portion 11 supplies a sheet P in a right direction (conveying direction) from the sheet feeding cassette 110 to a sheet conveying path PP. The sheet conveying path PP is a conveying path that is disposed from the sheet feeding portion 11, passes through the registration roller pair 116, and passes through a transfer position TP disposed in the image forming portion 120.

The sheet feeding cassette 110 is loaded therein with the sheet P. The sheet feeding cassette 110 is drawable from the lower housing 21 in a front direction (direction facing a point over the paper surface of FIG. 1). The sheet feeding cassette 110 includes a lifting plate 111 that supports the sheet P. The lifting plate 111 inclines to push up a tip end edge of the sheet P.

The pickup roller 112 is disposed over the tip end edge of the sheet P that is pushed up by the lifting plate 111. When the pickup roller 112 rotates, the sheet P is pulled out from the sheet feeding cassette 110.

The sheet feeding roller 113 is disposed on a downstream side of the pickup roller 112 in the sheet conveying direction. The sheet feeding roller 113 sends further the sheet P downstream in the sheet conveying direction. In the meantime, the lower housing 21, the sheet feeding portion 11, the sheet feeding cassette 110, and a limiting mechanism 110T described later compose the sheet loading apparatus 1A (FIG. 1) according to the present embodiment. The sheet loading apparatus 1A stores the sheet P.

A sheet hits a nip portion of the registration roller pair 116, whereby inclination of the sheet with respect to the sheet conveying direction is corrected. The registration roller pair 116 conveys the sheet P to the image forming portion 120 in accordance with a timing when a toner image is transferred to the sheet P.

The image forming portion 120 includes a photosensitive drum 121, an electrifier 122, a light exposing device 123, a developing device 124, a toner container 125, a transfer roller 126, and a cleaning device 127.

On a more downstream side than the image forming portion 120 in the conveying direction, the image forming apparatus 1 further includes a fixing device 130 that fixes a toner image on the sheet P. The fixing device 130 includes a heat roller 131 that melts the toner on the sheet P and a pressure roller 132 that presses the sheet P against the heat roller 131. When the sheet P passes through between the heat roller 131 and the pressure roller 132, the toner image is fixed onto the sheet P.

The image forming apparatus 1 includes further a conveying roller pair 133 that is disposed downstream from the fixing device 130, a switching portion 70 that is disposed downstream from the conveying roller pair 133, lower ejecting rollers 134, upper ejecting rollers 135, and ejects the sheet P onto the ejecting tray 242 that is disposed over the sheet ejecting portion 241.

Figure 2:
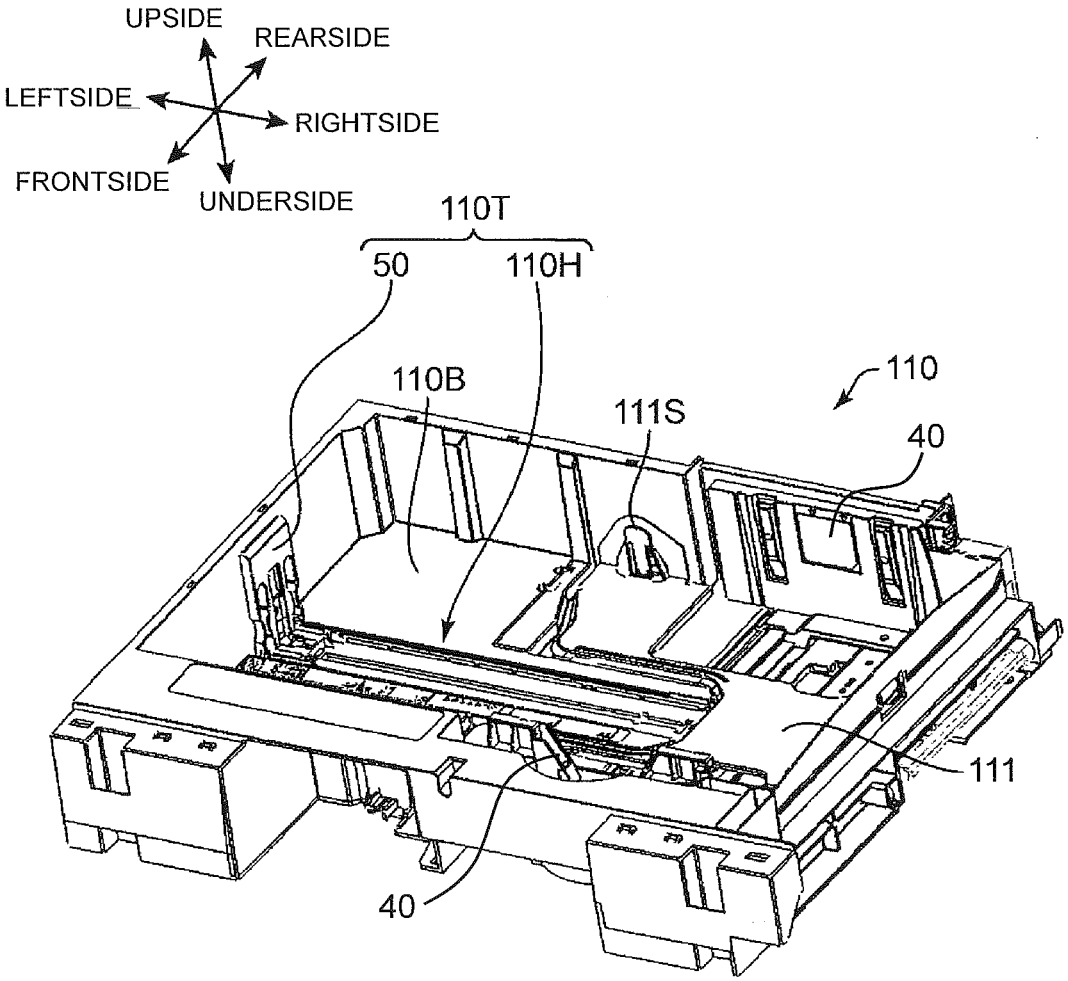
FIG. 2 is a perspective view of the sheet feeding cassette 110 including the sheet loading apparatus 1A according to an embodiment of the present disclosure.
Figure 3:
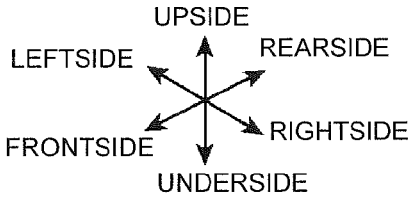
FIG. 3 is an enlarged perspective view around a limiting mechanism 110T composing the sheet loading apparatus 1A according the present embodiment.
Figure 3:
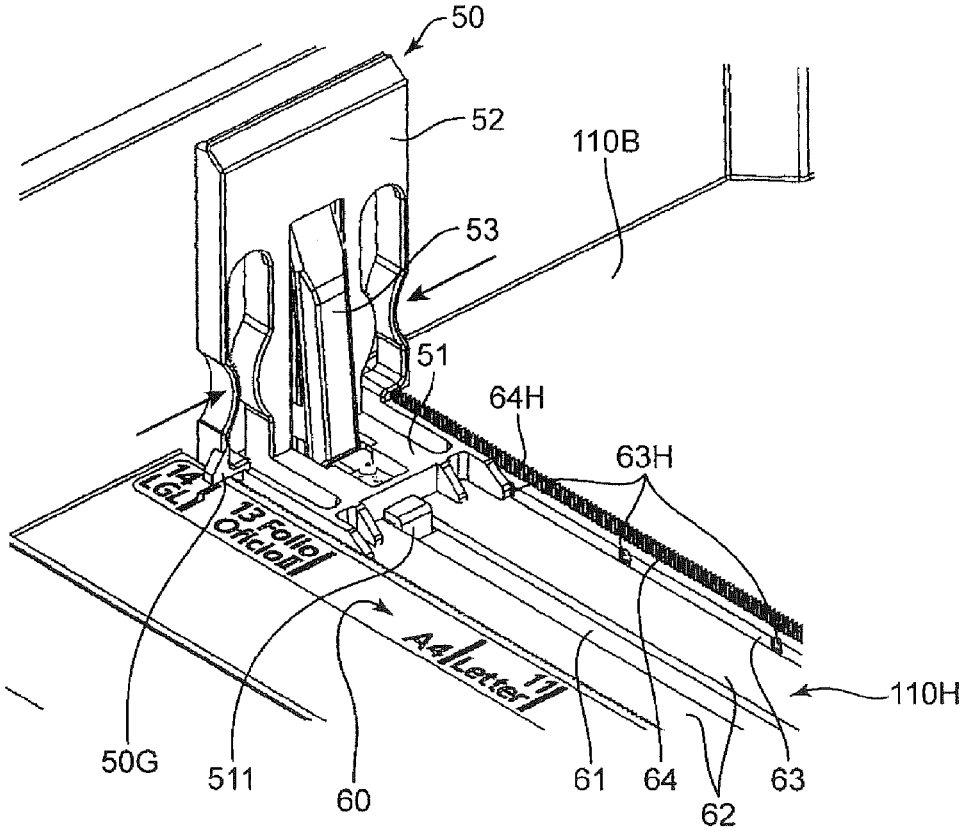
Figure 4:
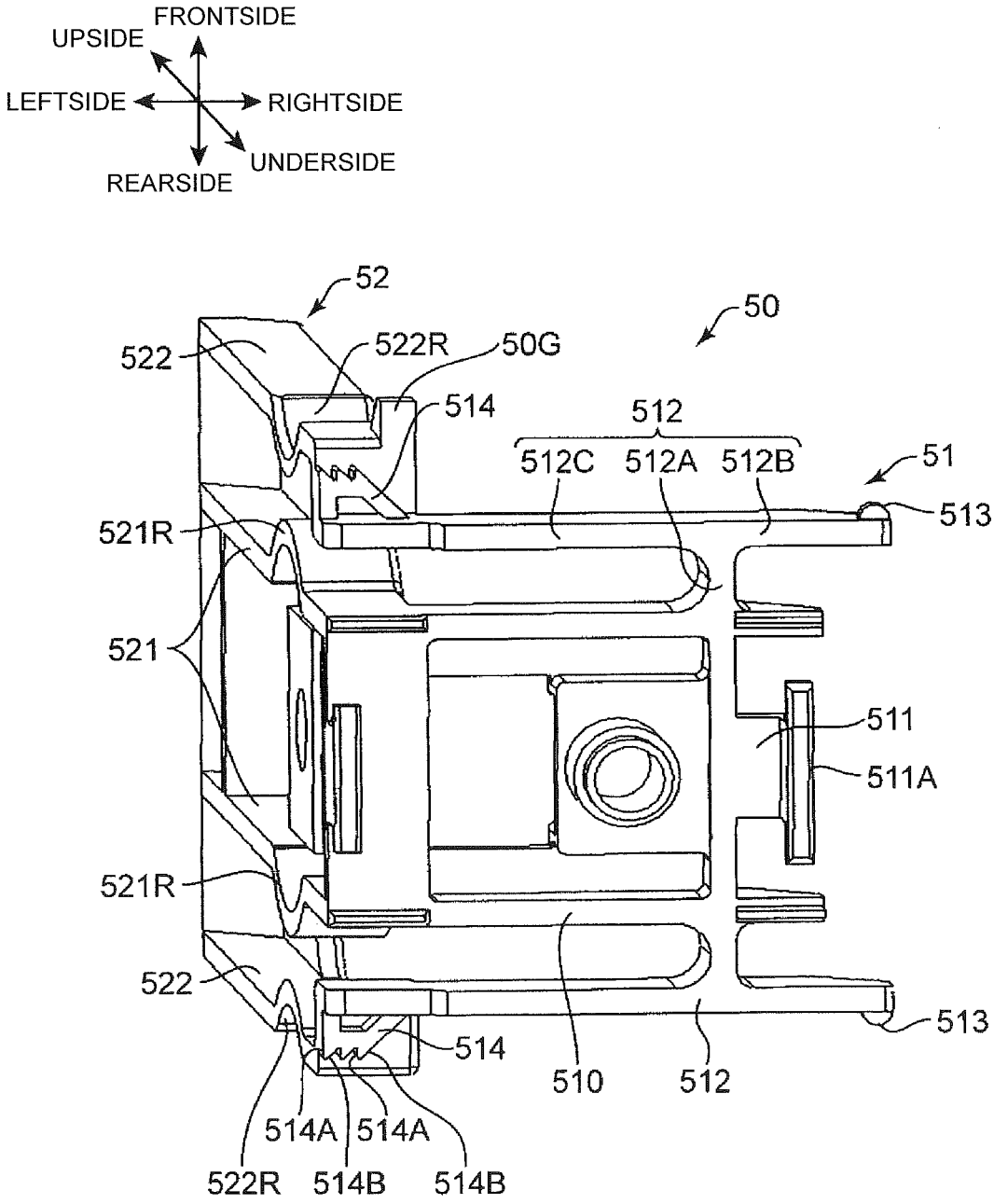
FIG. 4 is a perspective view of a rear end limiting portion 50 of the limiting mechanism 110T composing the sheet loading apparatus 1A according to the present embodiment.
Figure 5:
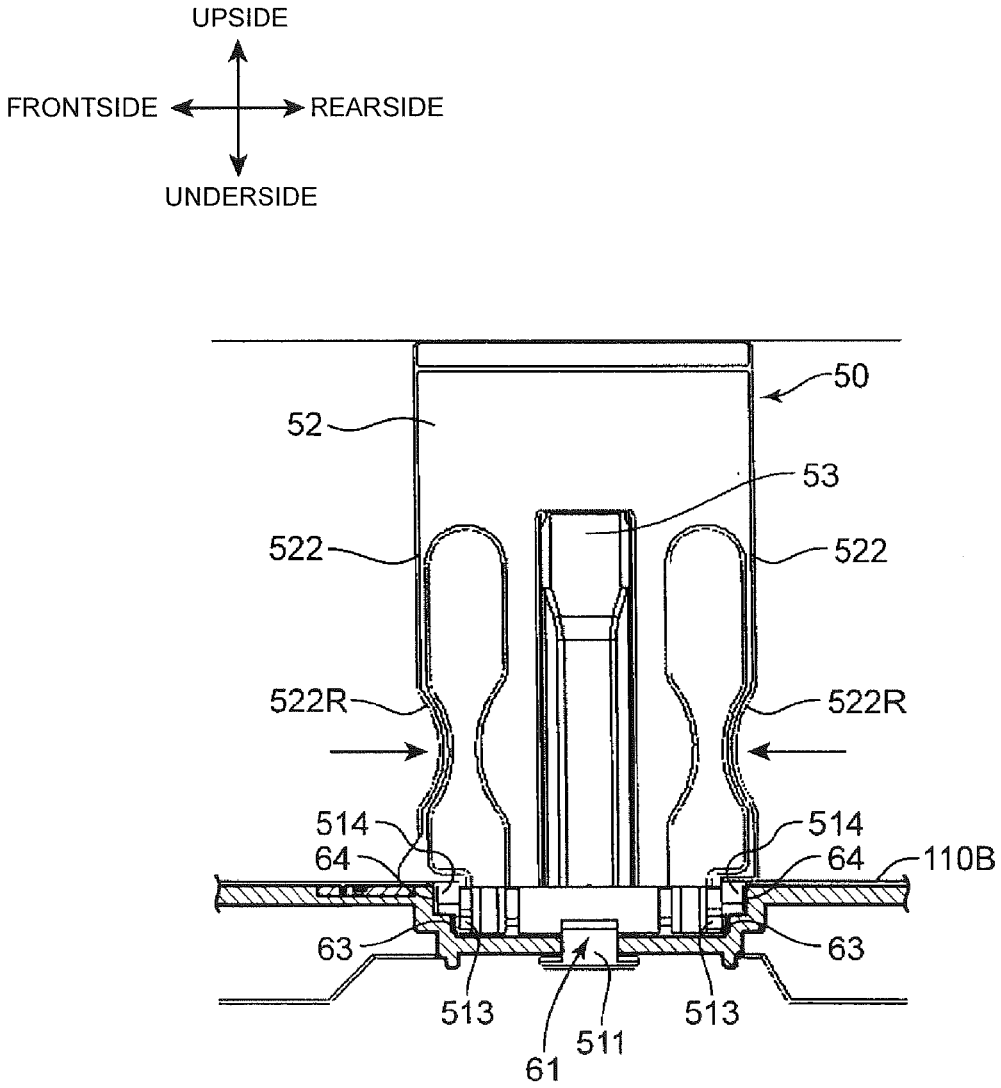
FIG. 5 is a side cross-sectional view of the limiting mechanism 110T composing the sheet loading apparatus 1A according to the present embodiment.

Next, the sheet loading apparatus 1A according to the present embodiment is described further in more detail. FIG. 2 is a perspective view of the sheet feeding cassette 110 including the sheet loading apparatus 1A according to an embodiment of the present disclosure. FIG. 3 is an enlarged perspective view around the limiting mechanism 110T composing the sheet loading apparatus 1A according the present embodiment. FIG. 4 is a perspective view of a rear end limiting portion 50 of the limiting mechanism 110T composing the sheet loading apparatus 1A according to the present embodiment. FIG. 5 is a side cross-sectional view of the limiting mechanism 110T composing the sheet loading apparatus 1A according to the present embodiment.

Referring to FIG. 2, the sheet feeding cassette 110 has a substantially rectangular parallelepiped shape and its upper surface is opened. The sheet feeding cassette 110 is stored therein with the sheet P. The sheet feeding cassette 110 includes a bottom portion 110B. The bottom portion 110B is a bottom surface of the sheet feeding cassette 110. The above lifting plate 111 is pivoted vertically about a pair of lifting plate support portions 111S as fulcrums that are supported by side walls of the sheet feeding cassette 10. In the meantime, in FIG. 2, only one (rear side) of the lifting plate support portions 111S is shown.

The sheet loading apparatus 1A includes the limiting mechanism 110T and a size indicating portion 60. The limiting mechanism 110T includes the rear end limiting portion 50 (limiting member) and a guide concave portion 110H. The rear end limiting portion 50 is disposed on the bottom portion 110B of the sheet feeding cassette 110 and butts an end edge of the sheet P extending in a front-rear direction (first direction), which is a width direction of the sheet P, to limit a position of the sheet P. In the meantime, in the present embodiment, the sheet P loaded in the sheet feeding cassette 110 is conveyed rightward by the pickup roller 112. In other words, the limiting mechanism 110T limits a rear end edge of the sheet P in the conveying direction. Besides, both side edges of the sheet P stored in the sheet feeding cassette 110, which extend in a left-right direction (second direction) that is the conveying direction of the sheet P, are limited by a width limiting member 40 (see FIG. 2). As a result of this, a position of the sheet P in the width direction (front-rear direction) is limited. The width limiting member 40 is slidable in accordance with a size of the sheet P stored in the sheet feeding cassette 110.

Referring to FIG. 3, the guide concave portion 110H is formed on the bottom portion 110B to extend in the left-right direction (second direction). A part of the bottom portion 110B is recessed along the left-right direction, whereby the guide concave portion 110H is formed. The guide concave portion 110H includes a guide groove 61, a guide bottom surface 62, a first engagement surface 63 (wall surface), and a second engagement surface 64. In the meantime, the guide concave portion 110H corresponds to an example of a "guide portion" of the present disclosure.

The size indicating portion 60 abuts a front side of the guide concave portion 110H and is disposed to extend in the left-right direction. The size indicating portion 60 indicate a plurality of kinds of sizes of the sheet P. Referring to FIG. 3, as an example, the size indicating portion 60 indicates an A4 size and a letter size.

The guide groove 61 is a concave portion that is formed along the left-right direction at a substantially central portion of the guide concave portion 110H in the front-rear direction (width direction). A guide piece 511 of the rear end limiting portion 50 described later is inserted into the guide groove 61.

The guide bottom surface 62 is a pair of flat portions that extend in the left-right direction across the guide groove 61 and a bottom surface of the guide concave portion 110H. The rear end limiting portion 50 slides on the guide bottom surface 62. The first engagement surface 63 is a pair of wall surfaces that are formed upright from end portions of the pair of guide bottom surfaces 62 in the front-rear direction. The pair of first engagement surfaces 63 is disposed to oppose each other across an interval in the front-rear direction, and each extend in the left-right direction. The second engagement surface 64 is a pair of wall portions that are formed upright outside the pair of first engagement surfaces 63 in the front-rear direction. The second engagement surface 64 is disposed at a position higher than the first engagement surface 63. These first engagement surface 63 and second engagement surface 64 correspond to a side surface of the guide concave portion 110H. And, the side surface of the guide concave portion 110H is formed into a step shape by the first engagement surface 63 and the second engagement surface 64.

The first engagement surface 63 is provided with an engagement hole 63H (first engaged portion). A plurality of the engagement holes 63H are disposed on the first engagement surface 63 in the left-right direction at predetermined intervals. The engagement hole 63H is a concave portion that is formed in the first engagement surface 63 and has an arc shape in a top view. The engagement holes 63H are disposed in pairs in the pair of first engagement surfaces 63 in the front-rear direction to interpose the rear end limiting portion 50. In the meantime, in FIG. 3, only the first engagement surface 63B and engagement holes 63H on a rear side are shown.

The second engagement surface 64 includes engagement gear teeth 64H (second engaged portion). The engagement gear teeth 64H are rack gears that are formed on the pair of second engagement surfaces 64 to interpose the rear end limiting portion 50. In other words, the engagement gear teeth 64H are disposed in pairs across an interval in the front-rear direction of the guide concave portion 110H. And, the engagement gear teeth 64H are formed continuously along the left-right direction of each of the second engagement surfaces 64.

In the meantime, describing, in other words, shapes of the first engagement surface 63 provided with the engagement holes 63H and the second engagement surface 64 provided with the engagement gear teeth 64H, the pair of first engagement surfaces 63 are formed, on the bottom portion 110B of the sheet feeding cassette 110, below the second engagement surface 64 and at an interval narrower than the interval of the pair of second engagement surfaces 64 in the front-rear direction (see FIG. 5). In the present embodiment, the guide concave portion 110H is formed integrally with the sheet feeding cassette 110 when a main body portion of the sheet feeding cassette 110 formed of a resin material is formed by resin molding.

In the present embodiment, a plurality of the engagement holes 63H are formed at predetermined intervals along the left-right direction in accordance with lengths of a plurality of kinds of standard sizes of the sheet P in the left-right direction (conveying direction) (see FIG. 3). In the meantime, here, a standard size is conformity with specifications of the image forming apparatus 1 depending on users and corresponds to a predetermined size of th sheet P. As examples, the A4 size, a 14-inch legal size, a 11-inch letter size and the like indicated on the size indicating portion 60 in FIG. 3 correspond to standard sizes. On the other hand, the engagement gear teeth 64H are formed continuously along the left-right direction in accordance with lengths of a plurality of kinds of nonstandard sizes of the sheet P. Here, a nonstandard size is a size of the sheet P that has a low use frequency at a user side of the image forming apparatus 1 and corresponds to a size other than the above standard sizes. In the meantime, as shown in FIG. 3, the engagement gear teeth 64H are formed continuously along the left-right direction. Because of this, the sheet P, which is loadable in the sheet feeding cassette 110 and has an arbitrary size, is usable as a nonstandard size. Besides, the sheet P of the nonstandard size includes the sheet P as well that is cut by the user and has a unique size.

The rear end limiting portion 50 is slidable in the left-right direction along the guide concave portion 110H and butts a rear end edge of the sheet P. The rear end limiting portion 50 is a member that is formed of a resin material and formed integrally by molding with a die. In a case of seeing from the front-rear direction, the rear end limiting portion 50 has a substantially L shape. The rear end limiting portion 50 includes a horizontal portion (base portion) 51 and a vertical portion 52 (FIG. 3, FIG. 4).

The horizontal portion 51 corresponds to a lower portion of the rear end limiting portion 50 and includes a function of moving along the guide concave portion 110H. Besides, the horizontal portion 51 is disposed to oppose the lowermost surface of the sheet P loaded in the sheet feeding cassette 110. Referring to FIG. 4, the horizontal portion 51 includes a base portion 510, the guided piece 511, and a pair of engagement portions 512.

The base portion 510 is disposed at a substantially central portion of the horizontal portion 51. The base portion 510 is disposed along the bottom portion 110B and has a hollow rectangular shape. The guided piece 511 is a protrusion member that is formed to protrude from a right end edge of the base portion 510. As shown in FIG. 4, the guided piece 511 has a substantially T shape. The guided piece 511 is formed to protrude from the base portion 510 in a right direction, thereafter, bent downward, and includes, at its tip end portion, an elongate engagement piece 511A (FIG. 4) that extends in the front-rear direction. As shown in FIG. 5, the guided piece 511 is disposed in the guide groove 61 of the guide concave portion 110H. At this time, the engagement piece 511A of the guided piece 511 is engaged with lower surfaces of the pair of guide bottom surfaces 62. As a result of this, the rear end limiting portion 50 is prevented from coming off the bottom portion 110B. In the meantime, the guided piece 511 is disposed into the guide groove 61 from a not-shown inserting hole formed through a right end portion of the guide concave portion 110H.

Referring to FIG. 4, the pair of engagement portions 512 are respectively connected to both end portions of the base portion 510 in the front-rear direction an a pair of outside ribs 522 described later. The engagement portion 512 has a substantially T shape when seeing from a vertical direction. The engagement portion 512 includes a connecting piece 512A (support piece), a first extending portion 512B, and a second extending portion 512C.

The connecting piece 512A is formed to protrude from end edges of the base portion in the front-rear direction. The first extending portion 512B is formed to extend in the right direction from a tip end portion of the connecting piece 512A. Besides, the second extending portion 512C is formed to extend from the tip end portion of the connecting piece 512A in the left direction, that is, in a direction opposite to the first extending portion 512B in the left-right direction. A tip end portion (left end portion) of the second extending portion 512C is connected to a lower end portion of the outside rib 522 described later.

Each of the pair of first extending portions 512B includes a standard-size engagement portion 513 (first engagement portion). The standard-size engagement portion 513 is a protrusion that is formed to protrude from a tip end portion of the first extending portion 512B toward outside in the front-rear direction. As shown in FIG. 4, the standard-size engagement portion 513 is composed of an arc-shaped convex portion in a plane view (top view). This standard-size engagement portion 513 is formed to protrude toward the engagement hole 63H of the guide concave portion 110H (FIG. 3). And, the standard-size engagement portion 513 is able to engage with the engagement hole 63H following the sliding of the rear end limiting portion 50.

Besides, each of the pair of second extending portions 512C includes an arbitrary-size engagement portion 514 (second engagement portion). The arbitrary-size engagement portion 514 is an engagement piece that is formed to protrude from the tip end portion of the second extending portion 512C toward outside in the front-rear direction. As shown in FIG. 4, the standard-size engagement portion 514 has a substantially triangular shape in a plane view (top view). A tip end of the arbitrary-size engagement portion 514 is provided with three engagement teeth. This arbitrary-size engagement portion 514 is formed to protrude toward the engagement teeth gear 64H of the guide concave portion 110H with the rear end limiting portion 50 disposed on the guide concave portion 110H. And, as to the arbitrary-size engagement portion 514, an engagement position with the engagement gear teeth 64H moves following the sliding of the rear end limiting portion 50.

Besides, in a cross-sectional view (FIG. 5) crossing the left-right direction, the standard-size engagement portion 513 of the rear end limiting portion 50 is disposed below the arbitrary-size engagement portion 514. Besides, the standard-size engagement portion 513 is disposed at a position more inside than the arbitrary-size engagement portion 514 in the front-rear direction.

The vertical portion 52 corresponds to a vertical portion of the rear end limiting portion 50 and is formed vertically from the horizontal portion 51. The vertical portion 52 has a function of butting a rear end edge of the sheet P to limit the rear end of the sheet P. Referring to FIG. 4, the vertical portion 52 includes a pair of inside ribs 521, a pair of outside ribs 522, and an indicator 50G.

The inside ribs 521 are a pair of ribs that are a main body portion of the vertical portion 52 and formed to extend in the vertical direction. Besides, a lower portion of the inside rib 521 is provided with an inside arch portion 521R that is partially bent in an arch shape when seeing from the left-right direction. The inside arch portion 521R has a convex shape that is bent to approach the outside rib 522. Further, a lower end portion of the inside rib 521 is connected to a left end edge of the base portion 510 of the horizontal portion 51. Rigidity of the vertical portion 52 is maintained by the inside rib 521.

The outside ribs 522 (holding portion) are a pair of ribs that are formed to extend in the vertical direction at outside portions from the inside ribs 521 in the front-rear direction. The outside ribs 522 constitute end portions of the vertical portion 52 in the front-rear direction. A lower portion of the outside rib 522 is provided with an outside arch portion 522R that is partially bent into an arch shape. In the meantime, as shown in FIG. 4, the outside arch portion 522R is bent to approach the inside rib 521, and the inside arch portion 521R and the outside arch portion 522R are disposed to oppose each other in such a way that their circumferential surfaces approach each other. Further, the lower end portion of the outside rib 522 is connected to the tip end portion of the above second extending portion 512C. And, the above arbitrary-size engagement portion 514 is disposed at a connecting portion between the outside rib 522 and the second extending portion 512C. In the meantime, the outside ribs 522, which are disposed at an interval in the front-rear direction and include the pair of outside arch portions 522R, are elastically deformable toward the inside arch portions 521R. And, the outside arch portion 522R functions as a holding portion that is held by the user of the sheet feeding cassette 110.

In the meantime, referring to FIG. 3, the vertical portion 52 of the rear end limiting portion 50 is provided with a pushing piece 53. The pushing piece 53 is formed separately from the rear end limiting portion 50 and butts, with elastic force, the rear end edge of the sheet P loaded in the sheet feeding cassette 110. A not-shown bias spring is disposed between the vertical portion 52 and the pushing piece 53. When remaining sheets P placed on the lifting plate 111 of the sheet feeding cassette 110 decrease, an inclination angle of the lifting plate 111 becomes large. Even in this case, the pushing piece 53 biases the rear end edges of the sheets P placed on the lifting plate 111 toward the sheet feeding portion 11 (right direction). Accordingly, the sheets P are stably sent to the sheet feeding portion 11. In the meantime, the bias spring biasing the pushing piece 53 is not used for adjustment of the sliding and limiting position of the rear end limiting portion 50.

Besides, the indicator 50 G (FIG. 3, FIG. 4) is disposed at the lower end portion of the front outside rib 522 of the pair of outside ribs 522. The indicator 50G points to a sheet size indicated by the size indicating portion 60 (FIG. 3) of the guide concave portion 110H.

In the present embodiment, as described above, the rear end limiting portion 50 is a resin member that is formed by one-piece molding. Accordingly, the standard-size engagement portion 513 and the arbitrary-size engagement portion 514 are each composed of a one-piece member.

In FIG. 3, the rear end limiting portion 50 is disposed on a left end portion of the guide concave portion 110H. Here, the standard-size engagement portion 513 (FIG. 4) engages with the leftmost engagement hole 63H of the plurality of engagement holes 63H shown in FIG. 3. Besides, the arbitrary-size engagement portion 514 engages with a portion of the engagement gear teeth 64H located before and after the vertical portion 52. And, the indicator 50G points to a 14-inch legal size (14 LGL) displayed on the size indicating portion 60. In other words, the rear end limiting portion 50 is fixed at a limiting position (standard-size limiting position) for a standard-size sheet.

In a case where the user slides the rear end limiting portion 50 from the state shown in FIG. 3, the pair of outside arch portions 522R are held inward (toward the inside arch portion 521R) to approach each other. As a result of this, the outside rib 522 (FIG. 4) is elastically deformed toward the inside rib 521, and the arbitrary-size engagement portion 514 separates from the engagement gear teeth 64H following the elastic deformation of the outside rib 522, whereby the sliding of the rear end limiting portion 50 becomes possible. As described above, the standard-size engagement portion 513 (FIG. 4) has the arc shape. Accordingly, when the user moves the rear end limiting portion 50 in the left-right direction, the standard-size engagement portion 513 is separated easily and smoothly from the engagement hole 63H.

When the outside arch portion 522R is held and the rear end limiting portion 50 is slid with the second extending portion 512C deformed elastically inward from the state shown in FIG. 3, the standard-size engagement portion 513 butts the first engagement surface 63, whereby the first extending portion 512B is slightly deformed inward elastically (toward the guided piece 511) in the front-rear direction. In a case where the sheet P of a nonstandard size is loaded in the sheet feeding cassette 110, the user roughly disposes beforehand the rear end limiting portion 50 in accordance with the size of the sheet P, disposes the sheet P in the sheet feeding cassette 110, and makes the rear end limiting portion 50 approach the rear end edge of the sheet P. When the rear end limiting portion 50 is slid to butt the rear end edge of the sheet P of the nonstandard size, the user takes fingers off the outside arch portion 522R and the holding of the pair of outside arch portions 522R is lifted. And, the arbitrary-size engagement portion 514 engages again with the engagement gear teeth 64H with the aid of restoring force of the outside arch portion 522R (outside rib 522). As a result of this, the position of the sheet P of the nonstandard size in the left-right direction (conveying direction) is limited. In the meantime, in this case, as described above, the first extending portion 512B keeps its slight elastic deformation. At the limiting position (nonstandard-size limiting position) of the sheet P of the nonstandard size, the standard-size engagement portion 513 does not engage with the engagement hole 63H, but because of the elastic deformation of the first extending portion 512B, restoring force (reacting force) also acts on the second extending portion 512C continuous with the first extending portion 512B in a direction to approach the second engagement surface 64. Accordingly, the engagement of the arbitrary-size engagement portion 514 with the engagement gear teeth 64H is strongly maintained.

On the other hand, in a case where the rear end limiting portion 50 is moved to a limiting position of the A4 size from the state shown in FIG. 3, likewise, the outside arch portion 522R is held and the rear end limiting portion 50 is slid in the right direction. In a short time, when the standard-size engagement portion 513 reaches the rightmost engagement hole 63H of the three engagement holes 63H shown in FIG. 3, the first extending portion 512B kept in the elastic deformation returns to the original shape with the aid of the restoring force, whereby the standard-size engagement portion 513 engages with the engagement hole 63H. In addition to the indication by the indicator 50G, by means of a click feeling at the time when the standard-size engagement portion 513 engages with the engagement hole 63H, the user can recognize that the rear end limiting portion 50 reaches the position for the standard size. As a result of this, the rear end limiting portion 50 limits the rear end edge of a sheet of the A4 size, that is, a standard size. In the meantime, at the limiting position of such a standard size, in addition to the standard-size engagement portion 513, also the arbitrary-size engagement portion 514 engages with the engagement gear teeth 64H. Accordingly, the position of the rear end limiting portion 50 is maintained stably.

As described above, in the present embodiment, the rear end limiting portion 50 includes the standard-size engagement portion 513 and the arbitrary-size engagement portion 514, and the guide concave portion 110H includes the engagement hole 63H and the engagement gear teeth 64H. Because of this, by sliding the rear end limiting portion 50, it is possible to easily limit the positions of the standard-size and nonstandard-size sheets P. Especially, by using the elastic deformation of the first extending portion 512B and outside rib 522 of the rear end limiting portion 50 that is a single member, the engagement and disengagement of the standard-size engagement portion 513 and arbitrary-size engagement portion 514 are achieved. Accordingly, it is possible to perform the position adjustment of the rear end limiting portion 50 without using a complicated link mechanism and a spring member.

Besides, the standard-size engagement portion 513 and the arbitrary-size engagement portion 514 are formed integrally by the resin molding. Accordingly, it is possible to limit the rear end positions of the sheets P of various sizes by means of a simpler structure. Besides, the rear end limiting portion 50 includes the pair of first extending portions 512B that are disposed at an interval in the front-rear direction (first direction) and extend in the left-right direction (second direction), and the standard-size engagement portions 513 are formed to protrude from the tip ends of the pair of first extending portions 512B toward the engagement hole 63H. Accordingly, the engagement and disengagement between the standard-size engagement portion 513 and the engagement hole 63H is achieved by the elastic deformation of the first extending portion 512B. Further, each of the pair of outside arch portions 522R is held by the user to be elastically deformed inward, whereby the sliding of the rear end limiting portion 50 is easily achieved.

Further, in the present embodiment, the first extending portion 512B is connected to the second extending portion 512C, and the first extending portion 512B and the second extending portion 512C are supported by the connecting piece 512A. And, the arbitrary-size engagement portion 514 is fixed to the lower end portion of the outside rib 522, that is, the tip end portion (left end portion) of the second extending portion 512C. Because of this, in the case where the rear end limiting portion 50 is disposed at the limiting position for the nonstandard size, force is given to the second extending portion 512C by the restoring force due to th elastic deformation of the first extending portion 512B in such a way that the arbitrary-size engagement portion 514 comes into tight engagement with the engagement gear teeth 64H. Because of this, at the limiting position of the nonstandard size, the limiting position of the rear end limiting portion 50 is prevented from deviating.

In other words, at the limiting position of the standard-size sheet, the rear end limiting portion 50 is fixed stably by the standard-size engagement portion 513 and the arbitrary-size engagement portion 514. Besides, at the limiting position of the nonstandard-size sheet, the engagement between the arbitrary-size engagement portion 514 and the engagement gear teeth 64H is strongly maintained by the elastic deformation of the first extending portion 512B. Besides, the engagement and disengagement between the standard-size engagement portion 513 and the engagement hole 63H are smoothly achieved by the arc shape of the engagement hole 63H.

Besides, in the present embodiment, the rear end limiting portion 50 limits the rear end edge of the sheet P. Because of this, when the tip end side of the sheet P is pushed up by the lifting plate 111, a load is prone to act on the rear end limiting portion 50 because of weight of the sheet P. Even in such a case, as shown in FIG. 4, each engagement tooth of the arbitrary-size engagement portion 514 includes a first tooth surface 514A that is perpendicular to the conveying direction (second direction) on an upstream side of the sheet P in the conveying direction, and a second tooth surface 514B connected to a downstream side of the first tooth surface 514A in the conveying direction is inclined to cross the conveying direction. In detail, as the second tooth surface 514B advances in the conveying direction (second direction) of the sheet P, the second tooth surface 514B is inclined inward in a sheet width direction (front-rear direction). As described above, by setting the inclination direction of the engagement tooth, even in the case where the weight of the sheet P is exerted onto the rear end limiting portion 50, the first tooth surface 514A engages strongly with the rack gear. Accordingly, the arbitrary-size engagement portion 514 is prevented from being separated from the engagement gear teeth 64H. In the meantime, it is desirable that a tooth shape of the rack gear of the engagement gear teeth 64H has a shape line-symmetrical (opposite direction) with the engagement tooth of the arbitrary-size engagement portion 514.

Further, in the present embodiment, as shown in FIG. 5, the first engagement surface 63 and the second engagement surface 64 are formed into a step shape, and the engagement position between the standard-size engagement portion 513 and the engagement hole 63H and the engagement position between the arbitrary-size engagement portion 514 and the engagement gear teeth 64H are disposed at positions different from each other in the front-rear direction. Because of this, the engagement hole 63H and engagement gear teeth 64H formed on the bottom portion 110B of the sheet feeding cassette 110 are formable integrally when the bottom portion 110B undergoes the resin molding. In other words, when forming the sheet feeding cassette 110 by using two dies divided in a vertical direction, the engagement hole 63H and the engagement gear teeth 64H do not overlap each other in a pulling-out direction of the dies. Accordingly, it becomes possible to form integrally the engagement hole 63H and the engagement gear teeth 64H without using a complicated die.

Hereinbefore, the sheet loading apparatus 1A and image forming apparatus 1 according to the embodiment of the present disclosure are described, but the present disclosure is not limited to this, and for example, it is possible to employ modifications described below.

(1) In the above embodiment, the form is described, in which the arbitrary-size engagement portion 514 and the first extending portion 512B are connected to each other by the second extending portion 512C, but the present disclosure is not limited to this. In another modification, a form may be employed, in which the rear end limiting portion 50 does not include the second extending portion 512C; the arbitrary-size engagement portion 514 is disposed on the lower end portion of the outside rib 522 and the standard-size engagement portion 513 is disposed on the tip end portion of the first extending portion 512B. Besides, the positions of the standard-size engagement portion 513 and arbitrary-size engagement portion 514 are not limited to the tip end portions of the first extending portion 512B and second extending portion 512C, respectively.

(2) Besides, in the above embodiment, the form is described, in which the rear end limiting portion 50 limits the rear end edge of the sheet P, but the present disclosure is not limited to this. The limiting member of the present disclosure may limit the width direction of the sheet P.

The present disclosure provides a sheet loading apparatus in which the positions of standard-size and nonstandard-size sheets are limitable with a simple structure and an image forming apparatus that includes the sheet loading apparatus.

What is claimed is:

1. A sheet loading apparatus comprising:

a sheet loading portion that includes a bottom portion and on which a sheet is loaded, and a regulating mechanism that is disposed in the sheet loading portion and abuts an end edge of the sheet extending in a first direction to limit a position of the sheet in a second direction which intersects the first direction perpendicularly, wherein the regulating mechanism includes:

a guide portion including a pair of first engagement surfaces that are formed upright from the bottom portion, and that extend in the second direction, and a pair of second engagement surfaces that extend in the second direction, parallel to the pair of first engagement surfaces, a limiting member including a base portion, a horizontal portion that is connected in an elastically deformable manner to both side surfaces of the base portion in the first direction via a pair of support pieces that protrude from both side surfaces of the base portion in the first direction and that is disposed between the pair of first engagement surfaces, and a vertical portion that is formed upright perpendicularly from the horizontal portion and that limits the end edge of the sheet, the limiting member being slidable in the second direction along the guide portion and abutting the end edge of the sheet, the pair of first engagement surfaces are disposed to oppose each other across an interval in the first direction to interpose the limiting member, each of the pair of first engagement surfaces includes a plurality of first engaged portions that are formed at predetermined intervals along the second direction and that respectively are concave portions that oppose each other in the first direction, the pair of second engagement surfaces includes a pair of second engaged portions which are respectively formed thereon continuously along the second direction, the horizontal portion includes a pair of engagement portions including a pair of first extending portions that extend in the second direction from the support pieces and a pair of second extending portions that extend in a direction opposite to the first direction, the pair of first extending portions respectively include a pair of first engagement portions formed to protrude from a tip end thereof toward the plurality of first engaged portions, the pair of first engagement portions being convex portions that have a substantially same shape as the concave portions, the pair of first engagement portions each being able to engage with one of the plurality of first engaged portions because of sliding of the limiting member, the pair of second extending portions include a pair of second engagement portions that engage with the pair of second engaged portions and whose positions of the engagement with the pair of second engaged portions change because of sliding of the limiting member, a distance between the pair of first engagement portions is larger than a distance between the pair of first engagement surfaces, when the limiting member is disposed at a nonstandard-size regulating position that limits an end edge of a nonstandard-size sheet, the pair of second engagement portions engage with the second engaged portions, and the pair of first engagement portions abut the pair of first engagement surfaces, whereby the pair of first extending portions are elastically deformed, and when the limiting member is slid from the nonstandard-size regulating position and disposed at a standard-size limiting position that regulates an end edge of a standard-size sheet, the pair of first engagement portions engage with the pair of first engaged portions with the pair of first extending portions returning to an original shape by a restoring force thereof, wherein the limiting member includes:

the base portion that is disposed along the bottom portion, the vertical portion that is formed upright from the base portion, the pair of support pieces that are formed so as to protrude from both end portions of the base portion in the first direction, the pair of the first extending portions that are formed along the second direction to extend in a direction from tip ends of the pair of support pieces, the pair of second extending portions that are formed to extend from the tip end portions of the pair of support pieces along the second direction in a direction opposite to the first extending portions, and a pair of holding portions which are disposed across an interval in the first direction, whose upper end portions are connected to the vertical portion, whose lower end portions are connected to the second extending portions, and the lower end portions being elastically deformable in the first direction.

2. The sheet loading apparatus according to claim 1, wherein the concave portions and the convex portions each has an arc shape in a top view.

3. The sheet loading apparatus according to claim 1, wherein the pair of second engagement portions are a pair of engagement pieces that are formed on the pair of second extending portions, connected to the pair of holding portions, and each formed so as to protrude toward the second engaged portions, the pair of second engaged portions are composed of a pair of rack gears that are formed to oppose each other across an interval in the first direction with the limiting member interposed and formed continuously along the second direction, the pair of holding portions are held so as to approach each other while being elastically deformed, whereby the pair of second engagement portions becomes able to move from the pair of second engaged portions in a leaving direction and the limiting member becomes able to slide, and force for holding the pair of holding portions is removed, whereby the pair of second engagement portions engage with the second engaged portion by a restoring force of the pair of holding portions.

4. The sheet loading apparatus according to claim 3, wherein:

the pair of engagement pieces include engagement teeth composed of a first tooth surface perpendicular to the second direction and a second tooth surface that inclines inward from a tip end of the first tooth surface in the second direction, the first tooth surface and the second tooth surface being formed alternately continuously, and a tooth shape of each rack gear has a same shape as a corresponding one of the engagement teeth and faces in an opposite direction.

5. The sheet loading apparatus according to claim 1, wherein the limiting member is made from a resin material, and in the pair of engagement portions, the pair of first engagement portions and the pair of second engagement portions are formed integrally with each other by resin molding.

6. The sheet loading apparatus according to claim 1, wherein the pair of first engagement surfaces are formed on the bottom portion of the sheet loading portion and below the pair of second engagement surfaces where the pair of second engaged portions are formed, and an interval in the first direction of the pair of first engagement surfaces is narrower than an interval of the pair of second engagement surfaces.

7. An image forming apparatus comprising:

a sheet loading apparatus according to claim 1, and an image forming portion that forms an image on the sheet loaded in the sheet loading portion.

8. A sheet loading apparatus comprising:

a sheet loading portion that includes a bottom portion and on which a sheet is loaded, a regulating mechanism that is disposed in the sheet loading portion and abuts an end edge of the sheet extending in a first direction to limit a position of the sheet in a second direction which intersects the first direction perpendicularly, wherein the regulating mechanism includes:

a guide portion that is formed on the bottom portion to extend in the second direction, and a limiting member that is slidable along the guide portion in the second direction and abuts the end edge of the sheet, the guide portion includes:

a pair of first engaged portions that are formed at predetermined intervals along the second direction in accordance with lengths of a plurality of kinds of standard sizes of the sheet in the second direction, the pair of first engaged portions opposing each other in the first direction, and a pair of second engaged portions that are formed continuously along the second direction, the pair of second engaged portions opposing each other in the first direction, and the limiting member includes:

a pair of engaging portions that are composed of: a pair of first engagement portions able to engage with one of the plurality of first engaged portions because of sliding of the limiting member; and a pair of second engagement portions which engage with the pair of second engaged portions and whose positions of the engagement with the pair of second engaged portions change because of the sliding of the limiting member, the guide portion includes a pair of first engagement surfaces that are formed upright from the bottom portion, that are disposed to oppose each other across an interval in the first direction to interpose the limiting member, and that extend in the second direction, the pair of first engagement surfaces each having formed therein a plurality of the first engaged portions along the second direction, the first engaged portions being concave portions that oppose each other in the first direction, the limiting member includes a pair of first extending portions that are disposed in the first direction to oppose each other across an interval and that extend in the second direction, and the first engagement portions are formed to protrude from tip ends of the pair of first extending portions toward the pair of first engaged portions, wherein the limiting member includes:

a base portion that is disposed along the bottom portion, a vertical portion that is formed upright from the base portion, a pair of support pieces that are formed so as to protrude from both end portions of the base portion in the first direction, the pair of the first extending portions that are formed along the second direction to extend in a direction from tip ends of the pair of support pieces, a pair of second extending portions that are formed to extend from the tip end portions of the pair of support pieces along the second direction in a direction opposite to the first extending portions, and a pair of holding portions which are disposed across an interval in the first direction, whose upper end portions are connected to the vertical portion, whose lower end portions are connected to the second extending portions, and the lower end portions being elastically deformable in the first direction.

9. The sheet loading apparatus according to claim 8, wherein the pair of second engagement portions are a pair of engagement pieces that are formed on the pair of second extending portions, connected to the pair of holding portions, and each formed so as to protrude toward the second engaged portions, the pair of second engaged portions are composed of a pair of rack gears that are formed to oppose each other across an interval in the first direction with the limiting member interposed and formed continuously along the second direction, the pair of holding portions are held so as to approach each other while being elastically deformed, whereby the pair of second engagement portions become able to move from the pair of second engaged portions in a leaving direction and the limiting member becomes able to slide, and force for holding the pair of holding portions is removed, whereby the second engagement portions engage with the second engaged portions by a restoring force of the pair of holding portions.

10. The sheet loading apparatus according to claim 9, wherein the pair of engagement pieces include a pair of engagement teeth composed of a first tooth surface perpendicular to the second direction and a second tooth surface that inclines inward from a tip end of the first tooth surface in the second direction, the first tooth surface and the second tooth surface being formed alternately continuously, and a tooth shape of each rack gear has a same shape as a corresponding one of the engagement teeth and faces in an opposite direction.

11. The sheet loading apparatus according to claim 8, wherein the limiting member is made from a resin material, and in the pair of engaging portions, the pair of first engagement portions and the pair of second engagement portions are formed integrally with each other by resin molding.

12. An image forming apparatus comprising:

a sheet loading apparatus according to claim 8, and an image forming portion that forms an image on the sheet loaded in the sheet loading portion.

* * * * *